US010139078B2

(12) United States Patent
Shimoda

(10) Patent No.: US 10,139,078 B2
(45) Date of Patent: Nov. 27, 2018

(54) COMPACT OPTICAL ASSEMBLY FOR LED LIGHT SOURCES

(71) Applicant: Whelen Engineering Company, Inc., Chester, CT (US)

(72) Inventor: Kyle Shimoda, Middletown, CT (US)

(73) Assignee: Whelen Engineering Company, Inc., Chester, CT (US)

( * ) Notice: Subject to any disclaimer, the term of this patent is extended or adjusted under 35 U.S.C. 154(b) by 299 days.

(21) Appl. No.: 14/625,926

(22) Filed: Feb. 19, 2015

(65) Prior Publication Data

US 2016/0245482 A1 Aug. 25, 2016

(51) Int. Cl.

| | |
|---|---|
| ***F21V 7/09*** | (2006.01) |
| ***F21V 7/06*** | (2006.01) |
| ***F21V 7/08*** | (2006.01) |
| ***F21V 7/00*** | (2006.01) |
| ***F21V 13/04*** | (2006.01) |
| ***F21S 41/143*** | (2018.01) |
| ***F21S 41/20*** | (2018.01) |
| ***F21S 41/255*** | (2018.01) |
| ***F21S 41/33*** | (2018.01) |
| ***F21S 43/14*** | (2018.01) |
| ***F21S 43/15*** | (2018.01) |
| ***F21S 43/20*** | (2018.01) |
| ***F21S 43/31*** | (2018.01) |

(Continued)

(52) U.S. Cl.

CPC ..... *F21V 7/09* (2013.01); *F21S 41/143* (2018.01); *F21S 41/255* (2018.01); *F21S 41/28* (2018.01); *F21S 41/336* (2018.01); *F21S 43/14* (2018.01); *F21S 43/15* (2018.01); *F21S 43/26* (2018.01); *F21S 43/31* (2018.01); *F21S 43/40* (2018.01); *F21V 7/0033* (2013.01); *F21V 7/06* (2013.01); *F21V 7/08* (2013.01); *F21V 13/04* (2013.01); *F21Y 2103/10* (2016.08); *F21Y 2115/10* (2016.08)

(58) Field of Classification Search

CPC ..... F21V 7/09; F21V 7/06; F21V 7/08; F21V 7/0033; F21V 13/04

See application file for complete search history.

(56) References Cited

U.S. PATENT DOCUMENTS 1,235,275 A 7/1917 Wood
2,282,167 A 5/1942 Cullman (Continued)

FOREIGN PATENT DOCUMENTS

WO 2002014738 A1 2/2002

OTHER PUBLICATIONS

"Standard Plastic Lenses for Semiconductors," Ledil Oy, Tehdaskatu 13, 24100 SALO, Finland, Examples of Products, 14 pages (Aug. 3, 2005).

(Continued)

*Primary Examiner* — William N Harris

(74) *Attorney, Agent, or Firm* — Alix, Yale & Ristas, LLP

(57) ABSTRACT

A compact optical assembly includes a linear array of LEDs, a plurality of reflectors, a plurality of lenses, and a cover. The reflectors include two reflecting surfaces that surround the LED light sources. One of the reflecting surfaces is defined by an arc of an ellipse that narrows into a throat in the axial direction away from the LED light source and cooperates with the other reflecting surface and the lens to create a collimated beam of light.

20 Claims, 5 Drawing Sheets

(51) Int. Cl.

| | |
|---|---|
| ***F21S 43/40*** | (2018.01) |
| ***F21Y 103/10*** | (2016.01) |
| ***F21Y 115/10*** | (2016.01) |

(56) References Cited

U.S. PATENT DOCUMENTS

| | | | | |
|---|---|---|---|---|
| 3,774,023 | A | 11/1973 | Cobarg et al. | |
| 4,473,872 | A * | 9/1984 | Puckett | H01K 1/30 362/309 |
| 5,103,381 | A | 4/1992 | Uke | |
| 6,120,166 | A * | 9/2000 | Price | F21V 7/09 362/302 |
| 6,471,375 | B2 | 10/2002 | Kobayashi et al. | |
| 6,641,284 | B2 | 11/2003 | Stopa et al. | |
| 6,644,841 | B2 | 11/2003 | Martineau | |
| 6,739,738 | B1 | 5/2004 | Smith | |
| 6,758,582 | B1 | 7/2004 | Hsiao et al. | |
| 6,851,835 | B2 | 2/2005 | Smith et al. | |
| 6,986,593 | B2 | 1/2006 | Rhoads et al. | |
| 7,001,047 | B2 | 2/2006 | Holder et al. | |
| 7,008,079 | B2 | 3/2006 | Smith | |
| 7,070,310 | B2 | 7/2006 | Pond | |
| 7,079,041 | B2 | 7/2006 | Fredericks et al. | |
| 7,083,304 | B2 | 8/2006 | Rhoads et al. | |
| 7,083,313 | B2 | 8/2006 | Smith | |
| 7,114,832 | B2 | 10/2006 | Holder et al. | |
| 7,118,261 | B2 | 10/2006 | Fredericks et al. | |
| 7,158,019 | B2 | 1/2007 | Smith | |
| 7,172,319 | B2 | 2/2007 | Holder et al. | |
| 7,175,303 | B2 | 2/2007 | Kovacik et al. | |
| 7,246,917 | B2 | 7/2007 | Rhoads et al. | |
| 7,427,167 | B2 | 9/2008 | Holder et al. | |
| 7,438,447 | B2 | 10/2008 | Holder et al. | |
| 7,461,944 | B2 | 12/2008 | Alessio | |
| 7,520,650 | B2 | 4/2009 | Smith | |
| 7,674,018 | B2 | 3/2010 | Holder et al. | |
| 7,690,826 | B2 | 4/2010 | Kim | |
| 7,712,931 | B1 | 5/2010 | Smith | |
| 7,850,334 | B2 | 12/2010 | Holder et al. | |
| 7,850,345 | B2 | 12/2010 | Holder et al. | |
| 7,959,322 | B2 | 6/2011 | Smith | |
| 7,993,036 | B2 | 8/2011 | Holder et al. | |
| 8,246,212 | B2 | 8/2012 | Schaefer et al. | |
| 8,247,957 | B2 | 8/2012 | Chen et al. | |
| 2003/0165061 | A1 * | 9/2003 | Martineau | F21V 7/09 362/297 |
| 2007/0242461 | A1 | 10/2007 | Reisenauer et al. | |
| 2008/0165535 | A1 | 7/2008 | Mazzochette | |
| 2008/0205061 | A1 | 8/2008 | Holder et al. | |
| 2008/0259631 | A1 | 10/2008 | Holder et al. | |
| 2009/0016052 | A1 | 1/2009 | Holder et al. | |
| 2009/0021945 | A1 | 1/2009 | Holder et al. | |
| 2009/0043544 | A1 | 2/2009 | Holder et al. | |
| 2009/0168395 | A1 | 7/2009 | Mrakovich et al. | |
| 2010/0110677 | A1 * | 5/2010 | Stein | B60Q 1/2611 362/235 |
| 2010/0128489 | A1 | 5/2010 | Holder et al. | |
| 2010/0134046 | A1 | 6/2010 | Holder et al. | |
| 2010/0172135 | A1 | 7/2010 | Holder et al. | |
| 2010/0238669 | A1 | 9/2010 | Holder et al. | |
| 2010/0254128 | A1 * | 10/2010 | Pickard | F21V 7/0033 362/231 |
| 2011/0090685 | A1 * | 4/2011 | Peck | F21V 7/04 362/235 |
| 2012/0049748 | A1 | 3/2012 | Stuesse et al. | |
| 2012/0327655 | A1 | 12/2012 | Li | |
| 2013/0077332 | A1 * | 3/2013 | Hessling | B64D 47/06 362/470 |
| 2013/0235580 | A1 | 9/2013 | Smith | |
| 2013/0279159 | A1 | 10/2013 | Pickard et al. | |
| 2013/0306998 | A1 | 11/2013 | Ulasyuk | |
| 2018/0135831 | A1 * | 5/2018 | Smith | G02B 3/00 |

OTHER PUBLICATIONS

"OEM Module Guide," Dialight Lumidrives Ltd., 7 pages (2006).
"L2Optics Flare Lens," L2Optics Ltd., sales brochure, 2 pages (2005).

* cited by examiner

COMPACT OPTICAL ASSEMBLY FOR LED LIGHT SOURCES

BACKGROUND

This disclosure relates generally to LED light sources, and more particularly, to an optical assembly for use with an LED lamp.

It is traditional to arrange lights on a vehicle to perform a variety of functions, including fog lighting, warning lighting, spot lighting, takedown lighting, scene lighting, ground lighting, and alley lighting. Emergency vehicles such as police, fire, rescue and ambulance vehicles typically include lights intended to serve several of these functions. Generally speaking, larger lights are less useful than smaller lights because of limited mounting space on the vehicles, as well as aerodynamic and aesthetic considerations. The trend is toward very bright, compact lights which use LEDs for a light source.

Prior art optical configurations may not provide acceptable performance when the size of the light is reduced. These smaller configurations make it particularly difficult to provide focused beams of light of a desired intensity.

DETAILED DESCRIPTION

Figure 1:
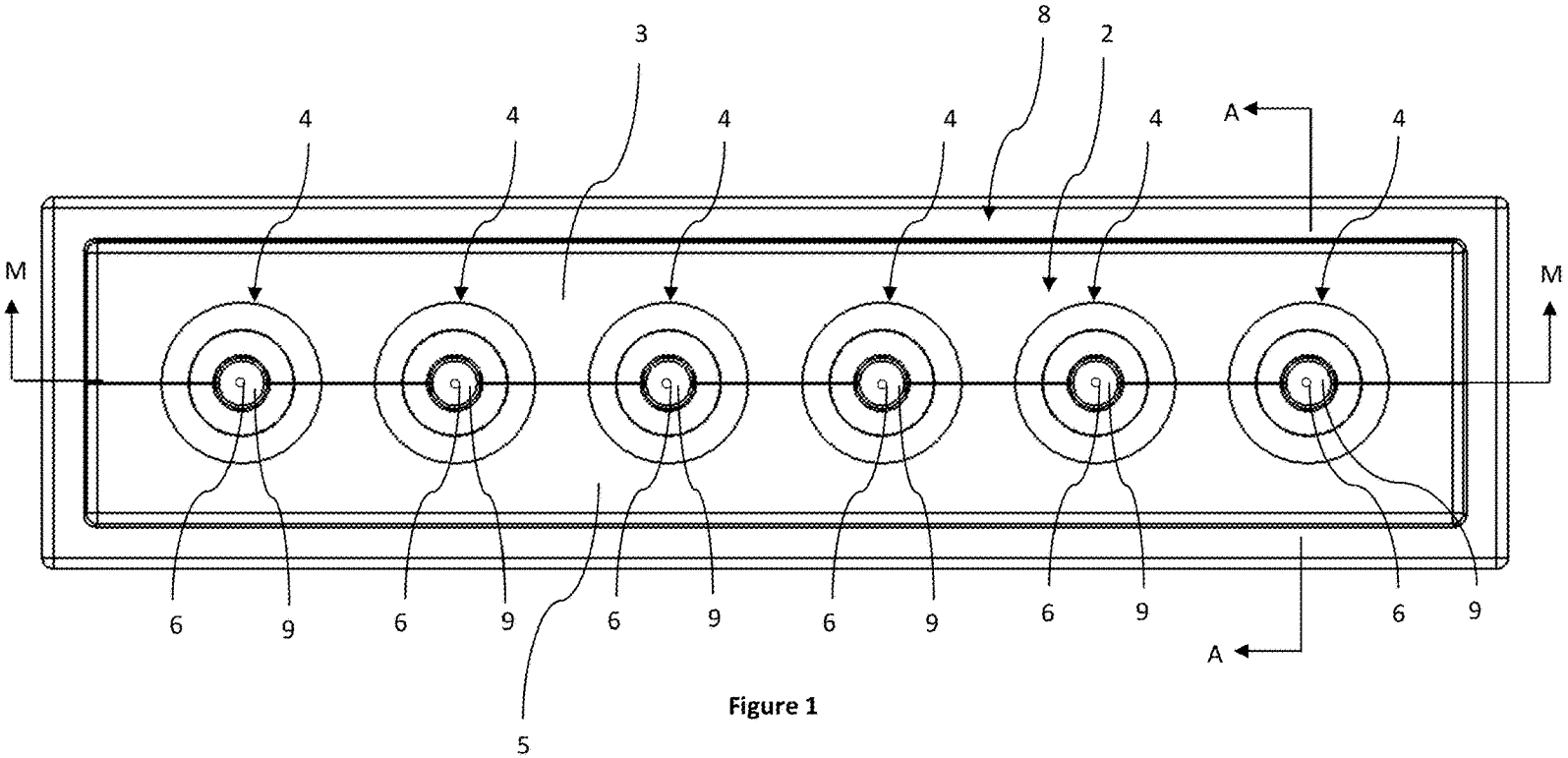
FIG. 1 is a top plan view of an embodiment of an optical assembly according to aspects of the disclosure.

Referring to FIG. 1, an embodiment of the disclosed optical assembly 2 comprises a plurality of reflectors 4 arranged along line M-M. LED light sources 6 are generally disposed in the center of the reflectors 4. The optical assembly 2 is covered by a light transmissive cover 8 incorporating a plurality of lenses 9. Each reflector 4 comprises two surfaces of rotation that cooperate to reflect part of the light emitted from LED light source 6.

Figure 2:
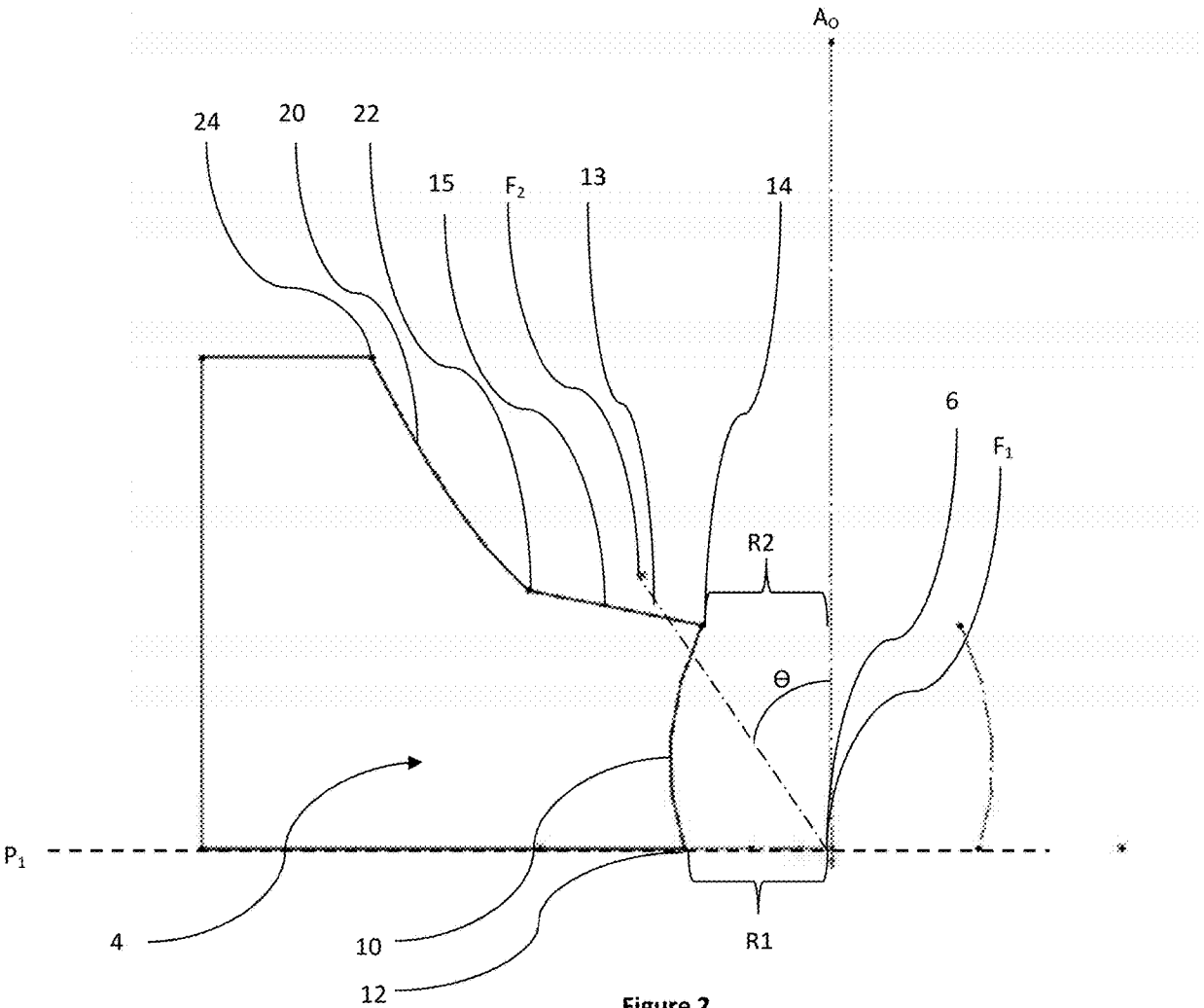
FIG. 2 is a partial diagrammatic sectional view of the reflector of FIG. 1 taken along line A-A thereof.

Referring to FIG. 2, each LED light source 6 of the depicted embodiment emits light in a hemispherical emission pattern to one side of first plane $P_1$, surrounding optical axis $A_o$. Optical axis $A_o$ extends from the area of light emission perpendicular to the first plane $P_1$. The reflector 4 comprises two reflecting surfaces 10, 20 that are surfaces of rotation about the optical axis $A_o$. The reflecting surfaces are configured to cooperate to redirect light rays divergent from optical axis $A_o$ and incident upon first reflecting surface 10 into a direction substantially parallel with optical axis $A_o$. The first reflecting surface 10 extends from a first terminus 12 to a second terminus 14. The second reflecting surface 20 extends from a third terminus 22 to a fourth terminus 24. The first reflecting surface 10 has a larger diameter at the first terminus 12 than at the second terminus 14, creating a narrow throat. A distance R1 between the optical axis $A_o$ and the first reflecting surface 10 at the first terminus 12 is larger than a distance R2 at the second terminus 14.

Figure 3:
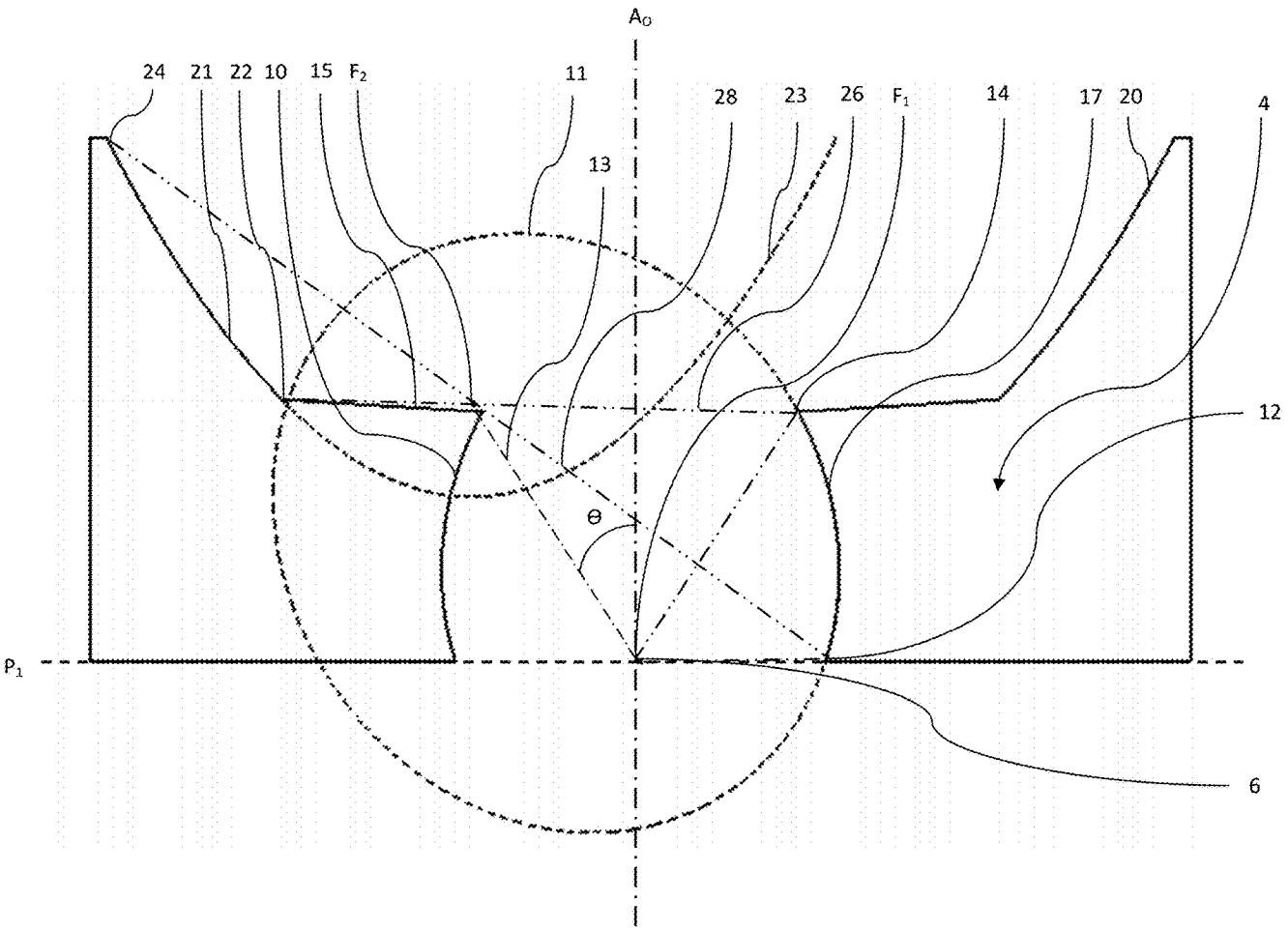
FIG. 3 is a diagrammatic sectional view of the reflector of FIG. 1 taken along line A-A thereof.

Referring to FIG. 3, the first reflecting surface 10 is defined by rotating an arc 17 of an ellipse 11 from the first terminus 12 to the second terminus 14 about optical axis $A_o$. The ellipse 11 has major axis 13 between first and second foci $F_1$, $F_2$ which is canted at an angle θ relative to optical axis $A_o$. In the depicted embodiment θ is approximately 30 degrees and the first focal point $F_1$ is coincident with the LED light source 6. Angle θ may range between 10 degrees and 50 degrees.

The second reflecting surface 20 is defined by rotating an arc 21 of a parabola 23 between the third terminus 22 and the fourth terminus 24 about optical axis $A_o$. In the depicted embodiment, the parabola 23 has a focus offset from the optical axis $A_o$ and coincident with the second focus $F_2$ of the ellipse 11. The third terminus 22 is defined axially by the reflection of a light ray 26 that intersects the first reflecting surface 10 at the second terminus 14. The fourth terminus 24 is defined axially by the reflection of a light ray 28 that intersects the first reflecting surface 10 at the first terminus 12, which passes the second terminus 14.

Figure 4:
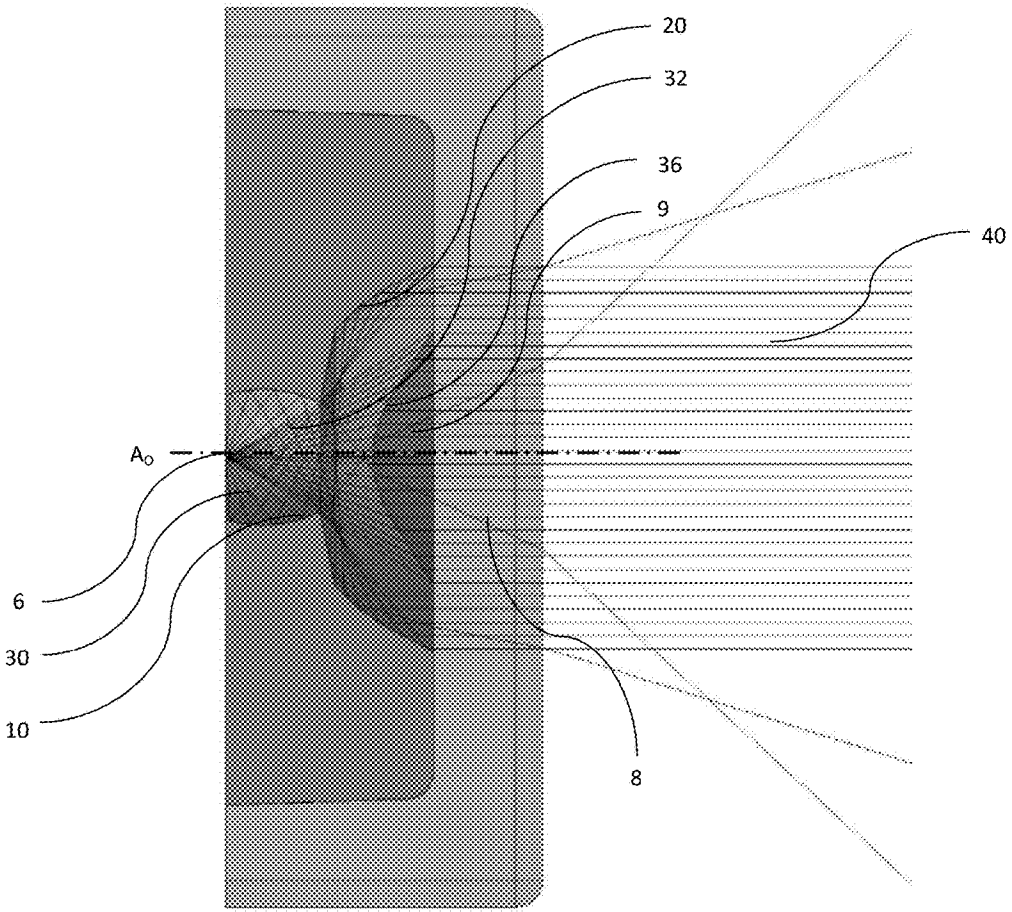
FIG. 4 is a diagrammatic sectional view of the embodiment of the optical assembly of FIG. 1 taken along line A-A thereof, depicting light ray tracing.

Referring to FIG. 4, in the depicted embodiment light rays emitted from the LED light source 6 may be characterized as either "wide angle" light rays 30 or "narrow angle" light rays 32. "Wide angle" light rays 30 are defined as light rays that are reflected by the first reflecting surface 10. In the depicted embodiment, "wide angle" light rays 30 have a trajectory greater than approximately 30 degrees from optical axis $A_o$. "Narrow angle" light rays 32 are defined as light rays that are not reflected by the first reflecting surface 10. In the depicted embodiment, "narrow angle" light rays 32 have a trajectory less than approximately 30 degrees from optical axis $A_o$.

Figure 5:
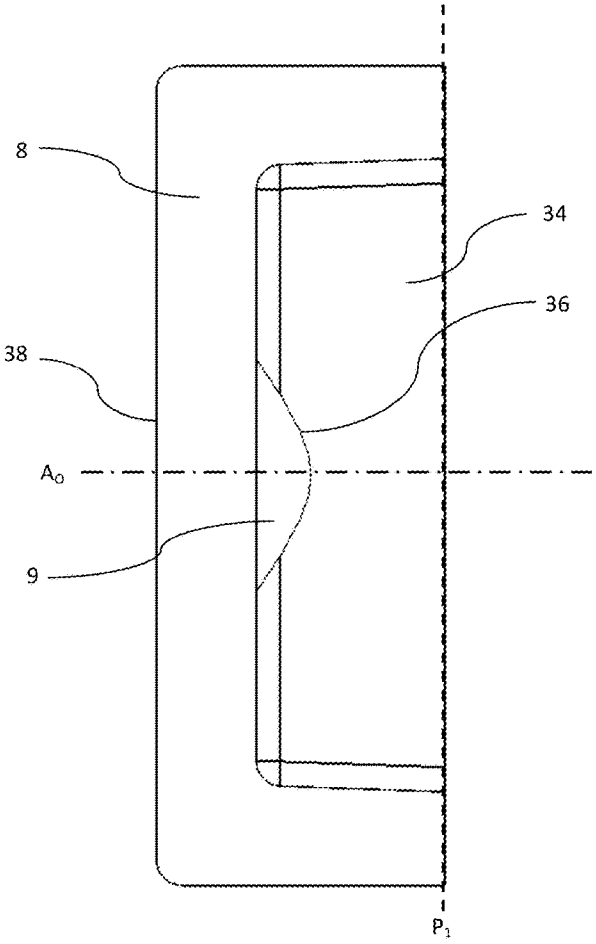
FIG. 5 is a diagrammatic sectional view of the lens of FIG. 1 taken along A-A thereof.

FIG. 5 illustrates one embodiment of a cover 8 incorporating the lens 9 compatible with the disclosed reflector 4. The cover 8 includes a cavity 34 for receiving the reflector 4 and LED light source 6. The lens 9 includes light entry surface 36 and the cover 8 includes light emission surface 38. Referring to FIG. 4, "narrow angle" light rays 32 are refracted into light entry surface 36 and are emitted by the light emission surface 38 substantially parallel to optical axis $A_o$. In the depicted embodiment, the light entry surface 36 is hyperbolic with a focus on the optical axis $A_o$. The diameter of the light entry surface 36 is defined by the "narrow angle" light rays 32 of the LED light source 6 within the optical assembly 2.

FIG. 4 depicts representative light collimation by reflection on the reflecting surfaces 10, 20 and by refraction through the lens 9. Light originates from LED light source 6 as "wide angle" light rays 30 and "narrow angle" light rays 32. "Wide angle" light rays 30 are reflected by first reflecting surface 10 and second reflecting surface 20, resulting in a collimated light beam 40 that is substantially parallel to optical axis $A_o$. "Narrow angle" light rays 32 are refracted upon entering lens 9 through light entry surface 36, also resulting in a collimated light beam 40 that is substantially parallel to optical axis $A_o$. In some embodiments, the collimated beam 40 may spread significantly from the optical axis $A_o$ depending on the application without departing from the spirit of the disclosure and the scope of the claimed coverage.

In one embodiment, there is a transition surface 15 located between the first 10 and second 20 reflecting surfaces. As depicted in FIG. 2, the transition surface 15 extends from the first reflecting surface 10 to the second reflecting surface 20. The transition surface 15 is defined by a substantially conical surface rotated about the optical axis $A_o$. In one embodiment, the transition surface 15 is reflective to redirect light out of the optical assembly 2.

In one embodiment, the optical assembly 2 is divided into upper optical assembly 3 and lower optical assembly 5 along line M-M as depicted in FIG. 1. In the depicted embodiment, the upper and lower optical assemblies 3, 5 are substantially mirror images of one another. Dividing the optical assembly 2 provides easier manufacturability of the optical assembly. Due to the narrow throat of first reflecting surface 10, as depicted in detail in FIGS. 2 and 3, injection molding or other similar manufacturing methods would be difficult without dividing the optical assembly 2 into multiple portions.

In one embodiment, the series of lenses 9 are manufactured integral with the cover 8 and are arranged along the line M-M as depicted in FIG. 1. The cover 8 provides support and locates the lenses 9 coaxial with the reflectors 4 and LED light sources 6. Alternate embodiments provide for manufacturing the lenses 9 separate from the cover 8 and using other mounting means.

What is claimed:

1. A reflector for use in conjunction with an LED light source, said LED light source having an LED optical axis ($A_o$) centered on an area of light emission from which light is emitted in a hemispherical emission pattern surrounding said optical axis ($A_o$), said light consisting essentially of light emitted to one side of a first plane ($P_1$) coincident with said area of light emission and perpendicular to said optical axis ($A_o$), said reflector comprising:

a first reflecting surface and a second reflecting surface rotationally symmetrical about optical axis ($A_o$), said first reflecting surface extending from said first plane ($P_1$) and defined by an arc of an ellipse rotated about said optical axis ($A_o$), said ellipse having a first ellipse focus coincident with said area of light emission and a major axis canted relative to said optical axis ($A_o$), and said second reflecting surface defined by an arc of a parabola rotated about said optical axis ($A_o$) having a parabola focus axially spaced from said first reflecting surface and radially spaced from said optical axis ($A_o$);

wherein said first reflecting surface and said second reflecting surface are configured to cooperate to redirect light rays divergent from said optical axis ($A_o$) into a direction substantially parallel with said optical axis ($A_o$).

2. The reflector of claim 1, wherein the ellipse has a second focus axially spaced from said first plane ($P_1$), radially spaced from said optical axis ($A_o$), and coincident with said parabola focus.

3. The reflector of claim 1, wherein said first reflecting surface has a first terminus at said first plane and a second terminus opposite said first terminus and wherein a diameter of said reflecting surface is larger at said first terminus than a diameter at said second terminus.

4. The reflector of claim 1, further comprising a lens centered on said optical axis ($A_o$) and defined by a light entry surface and a light emission surface, wherein said light entry surface is configured to cooperate to redirect light divergent from said optical axis ($A_o$) into a direction substantially parallel with said optical axis ($A_o$).

5. The reflector of claim 1, further comprising a transition surface extending from said first reflecting surface to said second reflecting surface.

6. The reflector of claim 5, wherein said transition surface is defined by a conical sectional configuration between said first and second reflecting surfaces defined by a line rotated about said optical axis ($A_o$).

7. The reflector of claim 5, wherein said transition surface is reflective to redirect light.

8. The reflector of claim 4, wherein said light entry surface is defined by a hyperbolic sectional configuration centered on said optical axis ($A_o$) and rotated about said optical axis ($A_o$).

9. The reflector of claim 3, wherein the second reflecting surface has a third terminus axially defined by the light ray reflected at said second terminus of said first reflecting surface.

10. The reflector of claim 3, wherein the second reflecting surface has a fourth terminus axially defined by the light ray reflected at said first terminus of said first reflecting surface.

11. The reflector of claim 1, wherein said major axis is canted between 10 and 50 degrees relative to said optical axis ($A_o$).

12. A beam forming optic for use in conjunction with an LED light source, said LED light source having an LED optical axis ($A_o$) centered on an area of light emission from which light is emitted in a hemispherical emission pattern surrounding said optical axis ($A_o$), said light consisting essentially of light emitted to one side of a first plane ($P_1$) coincident with said LED light source and perpendicular to said optical axis ($A_o$), said beam forming optic comprising:

a reflector rotationally symmetrical about optical axis ($A_o$) constructed from a first reflecting surface and a second reflecting surface, said first reflecting surface extending from said first plane ($P_1$) and defined by an arc of an ellipse rotated about said optical axis ($A_o$), said ellipse having a first ellipse focus coincident with said LED light source, a second ellipse focus axially spaced from said first plane ($P_1$) and radially spaced from said optical axis ($A_o$) and a major axis canted relative to said optical axis ($A_o$), and said second reflecting surface defined by an arc of a parabola rotated about said optical axis ($A_o$) having a parabola focus axially spaced from said first reflecting surface and radially spaced from said optical axis ($A_o$); and a lens centered on said optical axis ($A_o$) and defined by a light entry surface and a light emission surface;

wherein said first reflecting surface, said second reflecting surface, and said light entry surface are configured to cooperate to redirect light rays divergent from said optical axis ($A_o$) into a direction substantially parallel with said optical axis ($A_o$).

13. The beam forming optic of claim 12, wherein the second ellipse focus is coincident with said parabola focus.

14. The beam forming optic of claim 12, wherein said first reflecting surface has a first terminus at said first plane and a second terminus opposite said first terminus and wherein a diameter of said reflecting surface is larger at said first terminus than a diameter at said second terminus.

15. The beam forming optic of claim 12, further comprising a transition surface extending from said first reflecting surface to said second reflecting surface.

16. The beam forming optic of claim 15, wherein said transition surface is defined by a generally conical sectional configuration between said first and second reflecting surfaces defined by a line rotated about said optical axis ($A_o$).

17. The beam forming optic of claim 12, wherein said light entry surface is defined by a hyperbolic sectional configuration centered on said optical axis ($A_o$) and rotated about said optical axis ($A_o$).

18. The beam forming optic of claim 14, wherein the second reflecting surface has a third terminus axially defined by the light ray reflected at said second terminus of said first reflecting surface.

19. The beam forming optic of claim 14, wherein the second reflecting surface has a fourth terminus axially defined by the light ray reflected at said first terminus of said first reflecting surface.

20. The beam forming optic of claim 12, wherein said major axis is canted between 10 and 50 degrees relative to said optical axis ($A_o$).

* * * * *